United States Patent [19]

Olson

[11] 4,001,526

[45] Jan. 4, 1977

[54] ALTERNATE ACTION SWITCH

[75] Inventor: Harry W. Olson, Woodridge, Ill.

[73] Assignee: Molex Incorporated, Lisle, Ill.

[22] Filed: July 12, 1974

[21] Appl. No.: 487,977

[52] U.S. Cl. ..... 200/16 D; 339/273 R; 200/257

[51] Int. Cl.[2] ..... H01H 15/24

[58] Field of Search ..... 200/16 R, 16 B, 16 D, 200/16 E, 257, 258, 159 R, 159 A; 339/273 R, 273 F, 273 S

[56] References Cited

UNITED STATES PATENTS

| | | | |
|---|---|---|---|
| 3,259,728 | 7/1966 | DeRougemont et al. | 200/257 |
| 3,352,980 | 11/1967 | DeRougemont et al. | 200/16 D |
| 3,371,168 | 2/1968 | Milner | 200/16 D |
| 3,403,373 | 9/1968 | Dereymaeker | 339/273 R |
| 3,517,377 | 6/1970 | Olsson | 339/273 F |
| 3,525,828 | 8/1970 | Eckhart et al. | 200/16 D |
| 3,546,402 | 12/1970 | Spaeth et al. | 200/16 D |
| 3,567,891 | 3/1971 | Hinkelmann | 200/16 B |
| 3,646,300 | 2/1972 | Manabe | 200/258 X |
| 3,673,365 | 6/1972 | Schadow | 200/16 D X |
| 3,860,775 | 1/1975 | Koepke | 200/164 R |

*Primary Examiner*—Herman J. Hohauser
*Attorney, Agent, or Firm*—Louis A. Hecht

[57] ABSTRACT

An alternate action switch includes a housing defining a cavity within which an actuator is mounted for reciprocal movement between alternate positions wherein slider contacts on the actuator selectively engage fixed contacts supported by the housing within the cavity. Indexing of the actuator for movement between positions is accomplished by a cam block mounted on the housing and a cam follower mounted on the actuator. The cam block and follower are integrally connected respectively to the housing and actuator by means of flexible integral webs serving both to resiliently bias the follower and cam block toward one another and to constrain their movement to a single direction. Within the housing cavity the actuator is provided with recesses supporting loop contact portions of the slider contacts. Retention recesses within the actuator and latch arms on the contracts hold the slider contacts in position on the actuator.

3 Claims, 13 Drawing Figures

FIG. 3
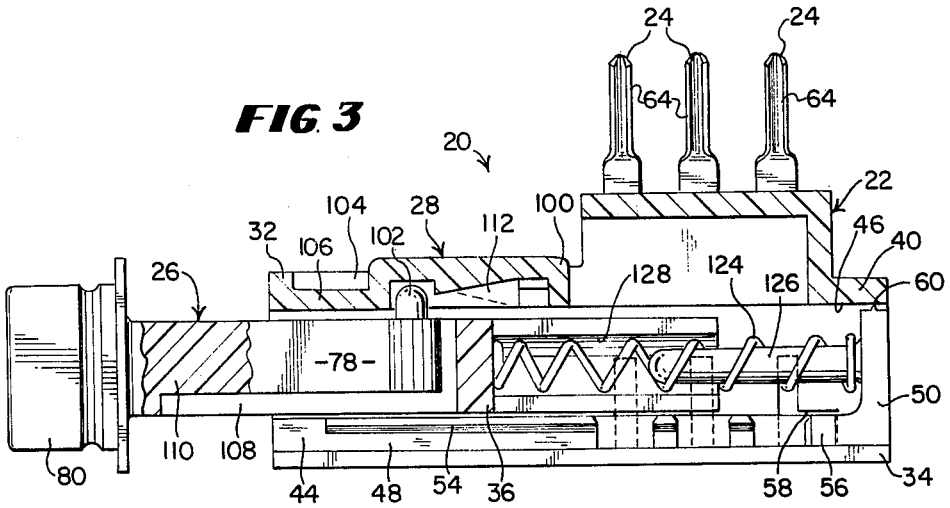
FIG. 4
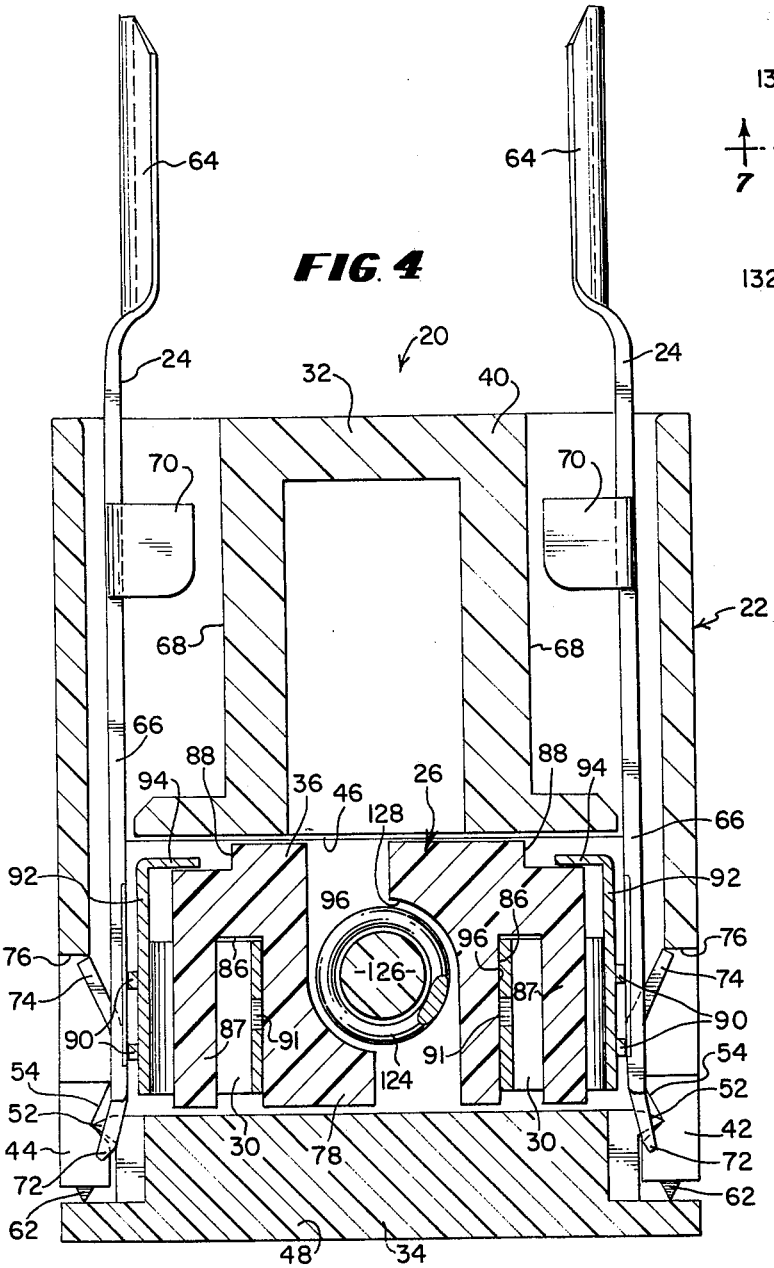
FIG. 5
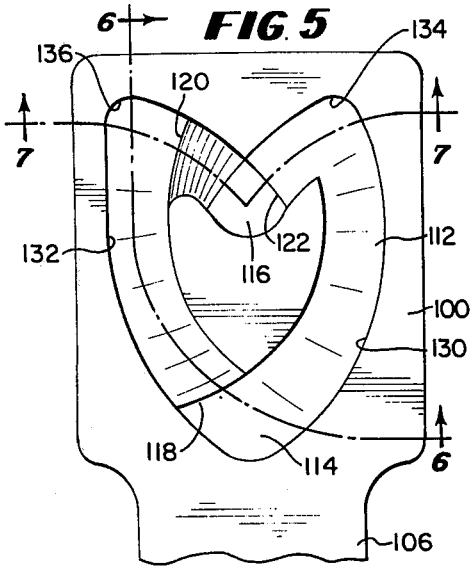
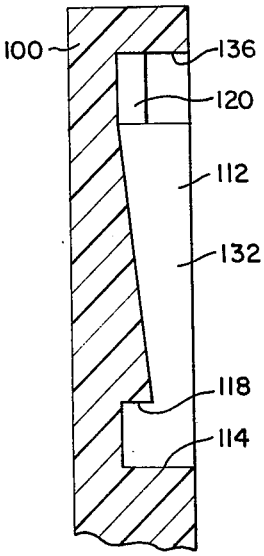
FIG. 6

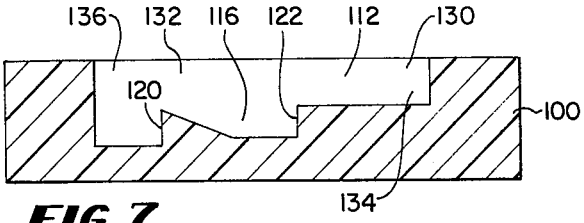
FIG. 7
FIG. 8
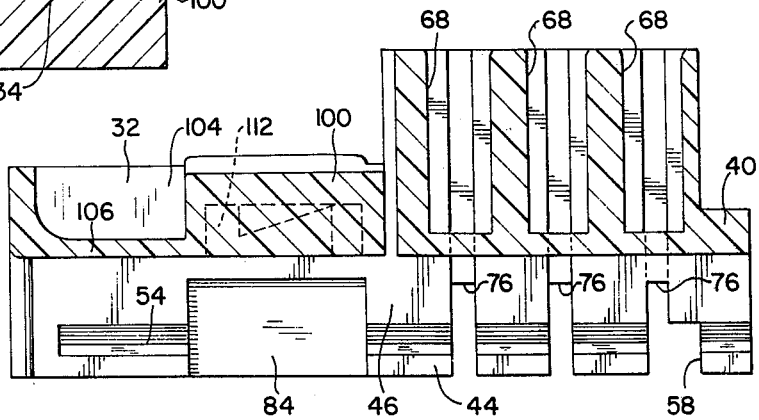
FIG. 9
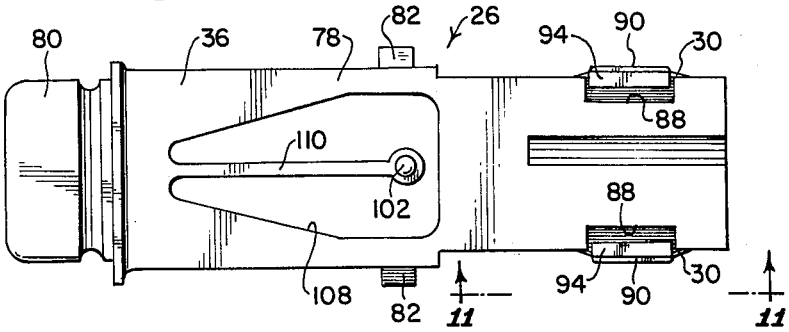
FIG. 11
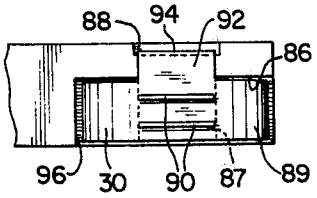
FIG. 10
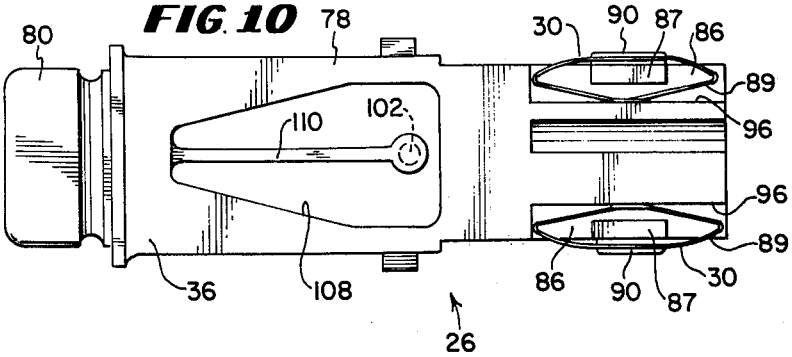
FIG. 12
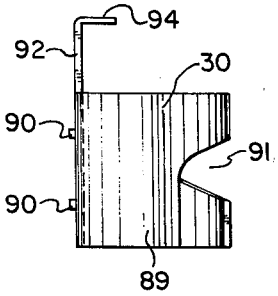
FIG. 13
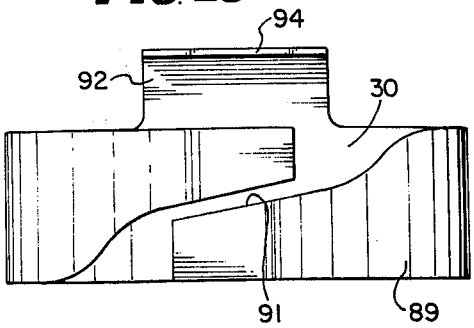

ALTERNATE ACTION SWITCH

The present invention relates to alternate action switches of the type wherein successive operations of the switch operate the switch between alternate conditions.

A known type of alternate action switch includes a slider or actuator movable within a housing cavity. Slider contacts on the actuator selectively bridge fixed contacts in the housing as the slider is moved between alternate positions. The switch is releasably retained in its two alternate positions by means of a cam and cam follower indexing mechanism. In the typical arrangement, a double lobed or heart-shaped cam track is engaged by a follower pin. Examples of alternate action switches of this type may be found in U.S. Pat. Nos. 3,229,584 — De Rougemont and 3,582,592 — Schadow.

The indexing mechanisms used in known alternate action switches have been subject to several difficulties, the principal one being complexity and expense. In known arrangements, the complexity of the mechanism has been increased due to complicated structures including springs, retainers, pins and other parts.

Indexing mechanisms have been developed for other purposes, one being retractable pens. An example of an indexing mechanism for this purpose is that incorporated in the "Sylvapen" writing instrument developed by Plastica Sudamericana S.A., Garin, Provincia o Buenos Aires, Argentina, and described at page 59 of "Design News-OEM", Oct. 22, 1973. This structure is not readily adaptable to alternate action switches, and if so used would require assembly operations beyond those necessary to assemble other switch components.

Alternate action switches developed heretofore have also been unduly complicated, and difficult as well as expensive to assemble. The contact arrangements have been particularly subject to this difficulty, and in addition have not been successful in providing reliable, low resistance electrical contact over a long period of use.

Among the important objects of the present invention are to provide an improved alternate action switch; to provide an indexing mechanism for an alternate action switch characterized by simplicity, reliability, and low cost; to provide a switch having an indexing mechanism requiring the assembly of no parts in addition to those required for other purposes; to provide a switch having a simple and reliable contact arrangement; and to provide an alternate action switch overcoming the disadvantages experienced with known switches of this type.

In brief, in accordance with the above and other objects of the present invention, there is provided an alternate action switch including a housing defining a cavity within which there are arranged a plurality of fixed switch contacts. An actuator is mounted for sliding reciprocal movement in the cavity and carries at least one movable slider contact. In accordance with an important feature of the invention, there is provided an indexing structure including first and second indexing members, one comprising a cam block having a cam track formed therein and the other comprising a cam follower. One indexing member is integrally connected to the housing by a first flexible web, and the other indexing member is integrally connected to the actuator by a second flexible web. The webs resiliently bias the cam block and follower into engagement with one another, and constrain movement of the indexing members to the desired directions to achieve indexing action.

Recesses in the actuator carry loop-shaped contact portions of the slider contacts. Retention recesses on the actuator accept latch arms formed on the loop portions, and the slider contacts are provided with latch arms engageable with the actuator for holding the contacts in position. The fixed contacts are provided by terminal members resiliently latched into position in the housing.

The invention together with the above and other objects and advantages may best be understood from consideration of the embodiment of the invention illustrated in the drawings, wherein:

FIG. 3 is a longitudinal sectional view taken along the line 3—3 of FIG. 2;

FIG. 4 is a cross sectional view of the switch on an enlarged scale taken along the line 4—4 of FIG. 2;

FIG. 5 is a bottom plan view of the cam block of the switch;

FIG. 6 is a sectional view of the cam block taken along the line 6—6 of FIG. 5;

FIG. 7 is a sectional view of the cam block taken along the line 7—7 of FIG. 5;

FIG. 8 is a sectional view of the main housing member taken along the line 8—8 of FIG. 2;

FIG. 9 is a top view of the actuator of the switch;

FIG. 10 is a bottom view of the actuator;

FIG. 11 is a side view of a portion of the actuator taken from the line 11—11 of FIG. 9;

FIG. 12 is an end view of a slider contact of the switch; and

FIG. 13 is a side view of the contact of FIG. 12.

Figure 1:
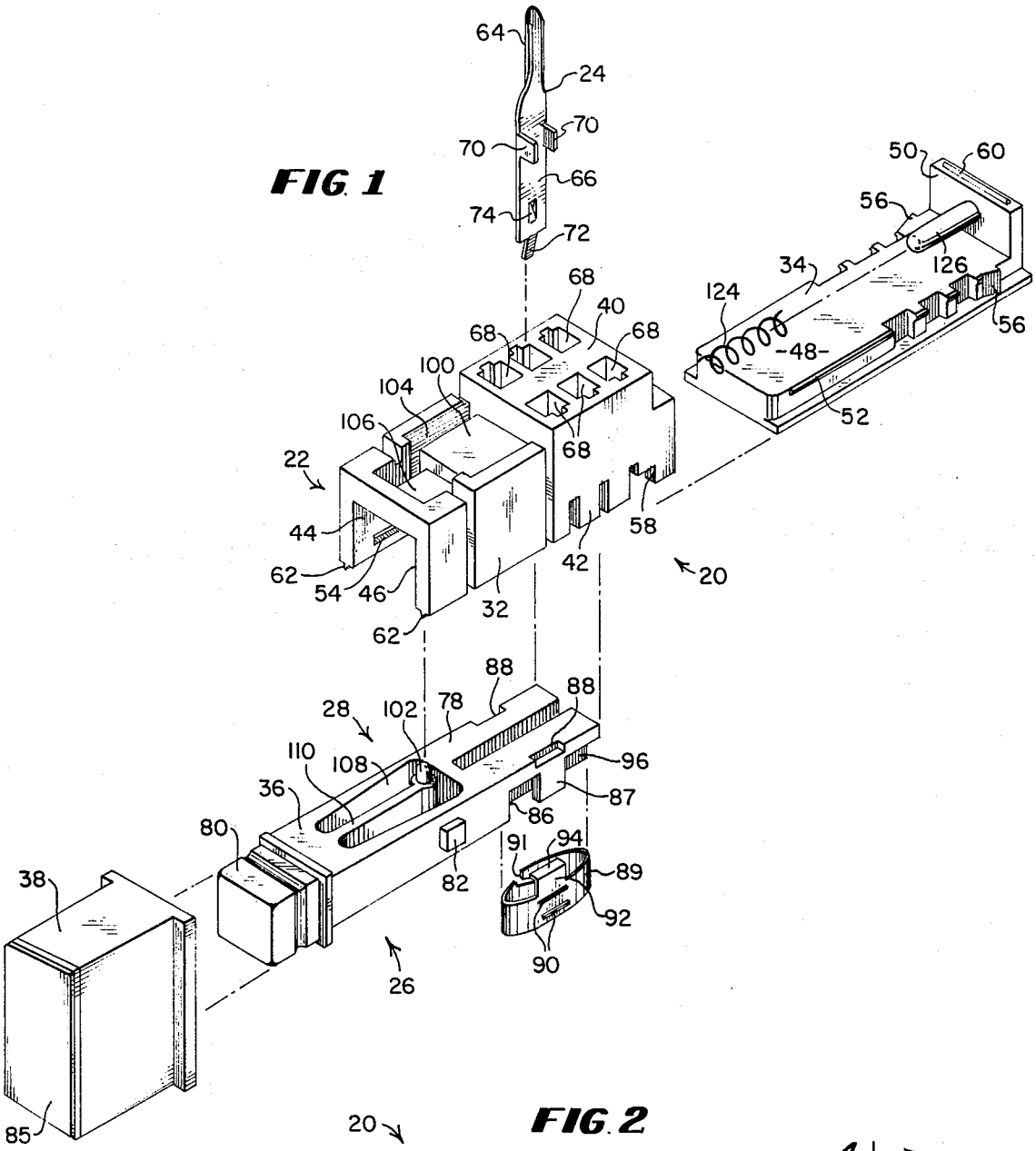
FIG. 1 is an exploded perspective view illustrating the components of an alternate action switch embodying the present invention.
Figure 2:
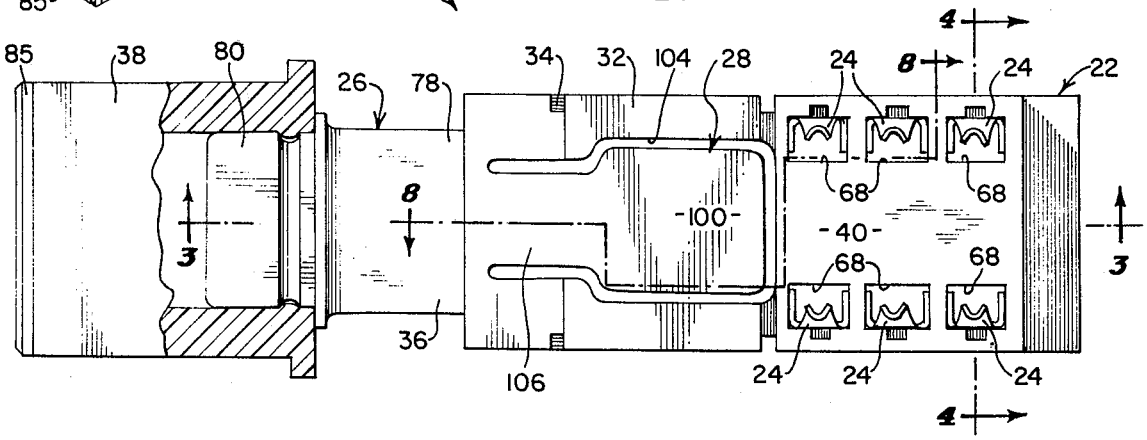
FIG. 2 is a top view of the switch.

Having reference now to the drawings, and initially to FIGS. 1–4, there is illustrated an alternate action switch constructed in accordance with the principles of the present invention and designated as a whole by the reference numeral 20. The switch 20 includes a housing assembly generally designated as 22 in which are supported a plurality of terminals 24. An actuator assembly generally designated as 26 is movable in the housing assembly 22 between alternate positions wherein electrical circuits are completed between various ones of the terminals 24.

In accordance with an important feature of the present invention, the switch 20 is provided with a novel indexing mechanism generally designated as 28 for releasably retaining the actuator assembly 26 in its alternative positions in the housing assembly 22. In accordance with another feature of the invention, the actuator assembly 26 includes a novel contact arrangement including a plurality of slider contacts, each generally designated as 30, for engaging selective ones of the terminals 24 in the alternate conditions of the switch 20.

Proceeding now to a more detailed description of the components and the operation of the switch 20, the housing assembly 22 includes a main housing member 32 and a housing cover 34. The actuator assembly 26 includes an actuator member 36 to which is attached an operating button 38. Each of the elements 32, 34, 36 and 38 is formed, preferably by molding, from a suitable plastic material.

In general configuraton the main housing member 32 is elongated and is roughly of a U-shaped cross section, including a base wall 40 and a pair of side walls 42 and 44. The walls 40, 42 and 44 define an open sided and open ended cavity 46 within which the actuator assembly 26 is supported for slidable movement.

In the assembly of the switch 20, after mounting of the actuator assembly 26 in the manner described below, the housing cover 34 is attached to the housing member 32. Cover 34 is of a generally L-shape and includes a main wall 48 and a flange portion 50 at one end. In assembly the cover 34 slides into position between the side walls 42 and 44 of the housing member 32, with guide protuberances or ridges 52 at the sides of main wall 48 being received in grooves 54 disposed at the inner surfaces of the side walls 42 and 44.

As the housing cover 34 reaches its fully assembled position, wedge-shaped locking protuberances 56 seat in latch openings 58 in the walls 42 and 44. The housing parts 32 and 34 may be permanently joined, as by an ultrasonic welding operation, and sharp edged ridges 60 (FIG. 3) and 62 (FIG. 4) are provided for this purpose.

In the illustrated embodiment of the invention, the switch 20 is a double pole, double throw switch, and two opposed rows each including three terminals 24 are provided. In the alternate positions of the switch 20, alternate pairs of the terminals 24 are bridged by contact with the slider contacts 30. It should be understood that the switch may be extended to include any desired number of terminals 24 and cooperating contacts 30 so that additional switching operations may be carried out.

In the illustrated arrangement, each of the terminals 24 is identical with the others, and includes a generally V-shaped solder tail contact portion 62 projecting from the exterior of the switch 20. It should be understood that other types of contacts such as solder loop contacts, wire crimp contact structure, and the like may be used for making connections in any desired fashion between the switch 20 and many types of external circuitry.

Each terminal 24 includes a generally blade-like main portion 66 receivable into a terminal receiving opening 68 formed in the housing 22. A pair of guide tabs 70 extend transversely of blade portion 66 to position each terminal 24 in an opening 68, and the inner end of the blade portion 66 is provided with an inclined tab 72 performing a camming operation as described below. When the terminal 24 reaches its fully inserted position, a resilient locking tang 74 engages a shoulder 76 defined on the wall 42 or 44 in order to prevent inadvertent withdrawal of the terminal from the switch housing 22. As can best be seen with reference to FIG. 4, after assembly of the switch, the blade portions 66 of the terminals 24 are disposed in spaced locations along the opposite sides of the housing cavity 46 and function as fixed switch contacts.

The actuator assembly 26 slides or reciprocates within the housing cavity 46 when the switch is manually operated, and to this end the actuator member 36 includes a main body or slider portion 78 received within the cavity 46 and an end portion 80 located outside of the housing 22. The actuator assembly 26 is received through the open side wall of the housing member 32 prior to assembly of the housing cover 34, as can best be seen in FIG. 1. A pair of studs or projections 82 upon opposite sides of the actuator 36 are received within downwardly open slots 84 (FIG. 8) in the housing member side walls 42 and 44. After the actuator assembly is mounted in position, the housing cover 34 is attached thus capturing the actuator member 36 within the cavity 46.

In order to provide for the use of different types of buttons 38, the button 38 is not formed intergrally with the actuator member 36, but if desired the two parts could be formed as a single unit. In the illustrated arrangement, the button 38 is attached by a snap fit to the end portion 80 of the actuator member 36. It should be noted that the end portion 80 is square so that the button 38 may be attached in either a generally vertical or a generally horizontal orientation. In addition, the button 38 is provided with a removable cover member 85 so that any desired color, indicia or the like may be provided on the button face.

In accordance with an important feature of the present inventin, the actuator assembly 26 is provided with a novel slider contact arrangement simplifying the assembly of the switch and providing desirable electrical switching properties. More specifically, each side of the actuator 36 is provided with a recess 86 for receiving one of the slider contacts 30, and retaining structure is provided for securely holding the contact in position during assembly of the switch while permitting desirable movement of the contact after assembly and during operation of the switch. In the illustrated arrangement a single slider contact 30 is provided at each side of the actuator 36 for bridging alternate pairs of the blade portions 66 of the terminals 24. In the event that more terminals 24 are provided, it should be understood that additional recesses 86 and contacts 30 may be associated with the actuator 36.

Each recess 86, as best seen in FIGS. 4 and 10, is generally rectangular in configuration and does not extend throughout the entire thickness of the slider portion 78. A retaining finger or peg 87 is disposed in each recess 86 and is generally coplanar with the side face of the slider portion 78. A smaller latching recess 88 is formed in the slider portion 78 opposite each contact recess 86.

Referring now more specifically to FIGS. 12 and 13, each slider contact 30 includes a generally oval, loop-shaped contact portion 89. The front face of the loop portion 89 is povided with a pair of contact ridges 90 slidably engageable with and selectively making electrical contact with the blade portions 66 of terminals 24. The loop 89 is formed by a pair of legs defining an open seam 91 at the opposite side of the loop portion 89. Extending laterally from the forward face of the loop portion 89 is a latching arm 92 having a bent over or flange portion 94 at its end.

When the slider contact 30 is assembled to the actuator 36, the loop portion is inserted into the recess 86 and around the retaining finger or peg 87. As can best be seen in FIGS. 4 and 11, the latching arm 92 extends over the side wall of the actuator 36 and the flange portion 94 is received in the latching recess 88. As a result, the slider contact 30 is held in position on the actuator 36, but advantageously is held somewhat loosely. The rear face of the loop portion abuts against a supporting wall 96 at the inside of the recess 86. Since the loop portion is somewhat resilient, it is compressed upon engagement with the blade portions 66 of the terminals 24 and provides a desirable resilient contact operation.

In the assembly of the switch 20, the slider contacts 30 are mounted on the actuator assembly 26 prior to mounting the assembly 26 in the housing member 32. When the actuator assembly is placed into position, the slider contacts are received within the housinb cavity 46 and are retained in position by means of the retaining pegs 87, the latching arms 92, and engagement with the side walls 42 and 44 of the housing member 32. As appears with reference to FIG. 4, when the terminals 24 are thereafter inserted into recesses 68 in the housing member, the inclined tabs 72 cam the slider contacts 30 inwardly to permit entry of the terminals to the desired position.

Another important feature of the present invention resides in the provision of the novel indexing mechanism 28. Importantly, this mechanism requires the fabrication and the assembly of no parts other than those required for the switching function. Thus, in the illustrated arrangement, the entire indexing mechanism 28 is formed integrally with the housing member 32 and the actuator member 36.

In accordance with the invention, the indexing mechanism 28 includes a cam block 100 integral with the housing member 32, together with a cam follower 102 integral with the actuator 36. When the switch is assembled, it is not necessary to fabricate and assemble additional parts such as separate pins, retainers, springs and the like in order to achieve the desired indexing function.

Referring first to the cam block 100, the housing member 32 is provided with a recess or opening 104 extending through the base wall 40. The cam block 100 is positioned in this recess, and as best appears in FIG. 8, is integrally connected to the base wall 40 by a web portion 106. By comparing FIG. 2 and FIG. 8, it can be seen that the web portion 106 is relatively thin in the illustrated vertical direction, but is relatively wide in the illustrated horizontal direction. As a result, the web portion is relatively flexible in one direction to permit the cam block 100 to move in the vertical direction. However, the width of the web portion 106 is such that side to side displacement of the cam block is prevented. Due to the plastic material of which the member 32 is formed, the web portion 106 is somewhat resilient so that the cam block is resiliently urged toward its normal position illustrated in FIG. 8.

With reference to the follower 102, the actuator member 36 is provided with an opening 108 extending through the slider portion 78. The follower 102 is disposed in this opening, and is integrally connected with the actuator 36 by means of a web portion 110. Like the web portion 106, the web portion 110 is relatively wide and relatively thin. However, the web portion 110 is disposed in a plane generally normal to that of the web portion 106, both webs being disposed in planes generally parallel with the direction of reciprocal movement of the actuator 36. As a result of this arrangement, the follower 102 is permitted by the web portion 110 to move from side to side, but is prevented from moving up and down. The web portion 110 is also somewhat resilient and provides a spring-like centering action.

In order to control the movement of the actuator 36 between its alternate positions, a double lobed or heart-shaped cam track 112 is formed in the downwardly facing surface of the cam block 100. The cam follower 102 in the illustrated arrangement is in the form of a follower pin having a rounded end slidably receivable in the cam track 112. As can best be seen with reference to FIGS. 5–7, the cam track includes first and second home positions 114 and 116 separated by a series of anti-retrograde movement ledges or stop shoulders 118, 120 and 122.

The actuator 36 is biased outwardly of the cavity 46 by a spring 124 (FIG. 3) held in compression between the housing 22 and the actuator 36. In the illustrated arrangement, the spring is held against the flange portion 50 of the housing cover 34 by a retainer pin 126, the other end of the spring being received in an opening 128 in the end of the actuator 36.

In the operation of the indexing mechanism, when the follower pin 102 is located in the first home position 114 of the cam track 112, the actuator 36 is in the more outward of its two alternate positions. The spring 124 holds the actuator 36 in this position until manipulation of the button 38.

If the button is pressed, the actuator 36 is moved inwardly against the force of the spring 124. The shoulder 118 guides the follower pin 102 around one lobe 130 of the cam track 112 and prevents movement around the other lobe 132. When the button 38 is fully depressed, the follower 102 reaches a corner 134 in the lobe 130. At this point, the resiliency of the web 110 urges the cam follower in a central direction toward the other home position 116. When the button 38 is released after operation, the spring 124 urges the actuator outwardly of the housing. Consequently, the follower 102 moves into the home position 116 wherein the actuator 36 is in the more inward of its two alternate positions.

In moving from the corner 134 to the second home position 116, the follower 102 traverses the shoulder 122. This requires movement of the cam block 100 in an up and down direction, and this movement is permitted by the web portion 106. Moreover, the resiliency of the web portion 106 serves continuously to bias the cam block downwardly as illustrated in FIG. 3 against the follower 102.

In operating the switch again, the actuator is returned from its inner to its outer alternate position. More specifically, when the button is first depressed, the follower 102 moves toward a corner 136 in the lobe 132. Movement in the other direction toward corner 134 is prevented by the shoulder 122. As the follower 102 reaches the corner 136, it traverses the shoulder 120.

The button 38 is released, and the actuator 36 is moved outwardly by the spring 124, the follower 102 moving along the lobe 132. The shoulder 120 prevents movement of the follower 102 back to the second home position 116. Rather, the follower moves to the first home position 114, and during this movement it traverses the stop 118.

While the invention has been described with reference to details of the illustrated embodiment, it should be understood that such details are not intended to limit the scope of the invention as defined in the following claims.

What is claimed and desired to be secured by Letters Patent of the United States is:

1. A switch assembly comprising in combination:

a housing including a main housing member and a housing cover, said main housing member defining an elongated cavity having open ends and an open side wall, said housing cover being engageable with said main housing member for closing said open side and the second of said open ends;

an actuator mounted for sliding movement along said cavity between alternate positions and insertable into said cavity through said open side, said actuator having an operating portion extending from said cavity through a first of said open ends for manual operation of said actuator, said actuator including a plurality of contact recesses formed therein;

a plurality of switch contacts mounted in said contact recesses, said switch contacts including loop portions disposed in said contact recesses and a latch arm extending from said loop portion and engageable with said actuator;

spring means in said cavity for biasing said actuator;

an indexing mechanism defined on said actuator and on said housing for releasably retaining said actuator in said alternate positions; and a plurality of terminals insertable into said cavity through said housing for engagement by said switch contacts.

2. The assembly of claim 1, said actuator including a retention recess receiving each contact protrusion and surrounded by the loop portion of the corresponding switch contact.

3. In a slide switch, the combination of a relatively fixed housing member defining a cavity, a slider mounted for sliding movement in said cavity, said housing member and slider having interfacing walls, a contact recess in said slider wall, a flexible resilient slider contact including a compressible loop portion in said contact recess, a retention peg integral with said slider extending through said loop portion, a latch recess in said slider wall spaced from said contact recess, said slider contact including a latch arm extending from said loop portion into said latch recess and cooperating with said retention peg for holding said slider contact on said slider, and fixed contacts in said cavity adjacent said housing wall engageable by said slider contact.

* * * * *